US008720353B2

(12) United States Patent
Nakamura et al.

(10) Patent No.: US 8,720,353 B2
(45) Date of Patent: May 13, 2014

(54) SEWING MACHINE

(71) Applicants: Yoshinori Nakamura, Toyohashi (JP); Satoru Makino, Nagoya (JP); Akie Shimizu, Nagoya (JP); Daisuke Abe, Nagoya (JP); Yoshio Nishimura, Nagoya (JP); Satoru Ichiyanagi, Nagoya (JP); Yutaka Nomura, Anjo (JP)

(72) Inventors: Yoshinori Nakamura, Toyohashi (JP); Satoru Makino, Nagoya (JP); Akie Shimizu, Nagoya (JP); Daisuke Abe, Nagoya (JP); Yoshio Nishimura, Nagoya (JP); Satoru Ichiyanagi, Nagoya (JP); Yutaka Nomura, Anjo (JP)

(73) Assignee: Brother Kogyo Kabushiki Kaisha, Nagoya (JP)

( * ) Notice: Subject to any disclaimer, the term of this patent is extended or adjusted under 35 U.S.C. 154(b) by 0 days.

(21) Appl. No.: 13/788,928

(22) Filed: Mar. 7, 2013

(65) Prior Publication Data

US 2013/0233219 A1 Sep. 12, 2013

(30) Foreign Application Priority Data

Mar. 12, 2012 (JP) ..... 2012-055109

(51) Int. Cl.
*D05B 21/00* (2006.01)

(52) U.S. Cl.
USPC ..... 112/470.06; 112/470.04; 112/102.05; 700/136

(58) Field of Classification Search
USPC ..... 112/102.5, 103, 470.01, 470.03, 112/470.04, 470.06, 475.18, 475.19; 700/136–138
See application file for complete search history.

(56) References Cited

U.S. PATENT DOCUMENTS

| | | | | |
|---|---|---|---|---|
| 3,966,331 | A | 6/1976 | Inuiya | |
| 4,998,489 | A * | 3/1991 | Hisatake et al. | 112/103 |
| 5,553,559 | A * | 9/1996 | Inoue et al. | 112/102.5 |
| 5,855,176 | A * | 1/1999 | Takenoya et al. | 112/102.5 |
| 6,000,350 | A * | 12/1999 | Koike et al. | 112/102.5 |
| 6,167,822 | B1 * | 1/2001 | Miyasako et al. | 112/102.5 |
| 6,871,606 | B2 * | 3/2005 | Schweizer | 112/102.5 |
| 7,079,917 | B2 | 7/2006 | Taguchi et al. | |

(Continued)

FOREIGN PATENT DOCUMENTS

| | | |
|---|---|---|
| JP | S64-040386 | 3/1989 |
| JP | A-06-000264 | 1/1994 |
| JP | A-2007-128120 | 5/2007 |
| JP | A-2009-172123 | 8/2009 |

OTHER PUBLICATIONS

U.S. Appl. No. 13/788,903, filed Mar. 7, 2013 in the name of Yoshio Nishimura et al.

(Continued)

*Primary Examiner* — Nathan Durham
(74) *Attorney, Agent, or Firm* — Oliff PLC

(57) ABSTRACT

A sewing machine includes a detector configured to detect ultrasonic waves transmitted from a specification-enabled area, a processor, and a memory storing non-transitory computer-readable instructions that instruct the sewing machine to perform specifying a prescribed position based on a positional relationship between a transmission area and the specification-enabled area, the transmission area being an area that is at least a portion of a sewing-enabled area and being an area that includes a position of a transmission source that transmits the ultrasonic waves, the prescribed position being a position of an embroidery frame when the entire transmission area is included in the specification-enabled area, moving the embroidery frame to the specified prescribed position, specifying a transmission position based on the ultrasonic waves that are detected by the detector, and performing a sewing operation based on the specified transmission position.

11 Claims, 16 Drawing Sheets

(56) References Cited

U.S. PATENT DOCUMENTS

| | | | | |
|---|---|---|---|---|
| 7,155,302 | B2 * | 12/2006 | Muto et al. | 700/138 |
| 7,373,891 | B2 | 5/2008 | Koerner | |
| 7,854,207 | B2 * | 12/2010 | Kuki et al. | 112/102.5 |
| 8,061,286 | B2 * | 11/2011 | Hirata et al. | 112/470.01 |
| 8,286,568 | B2 * | 10/2012 | Tokura | 112/102.5 |
| 8,301,292 | B2 * | 10/2012 | Tokura | 700/138 |
| 8,528,491 | B2 | 9/2013 | Bentley | |
| 2004/0182295 | A1 | 9/2004 | Pfeifer | |
| 2009/0188413 | A1 | 7/2009 | Hirata et al. | |
| 2011/0048299 | A1 * | 3/2011 | Tokura | 112/102.5 |
| 2012/0111249 | A1 | 5/2012 | Sekine | |
| 2012/0210925 | A1 | 8/2012 | Koga et al. | |
| 2013/0233217 | A1 | 9/2013 | Shimizu et al. | |

OTHER PUBLICATIONS

U.S. Appl. No. 13/789,046, filed Mar. 7, 2013 in the name of Daisuke Abe et al.

U.S. Appl. No. 13/789,061, filed Mar. 7, 2013 in the name of Yoshio Nishimura et al.

U.S. Appl. No. 13/788,979, filed Mar. 7, 2013 in the name of Yutaka Nomura et al.

U.S. Appl. No. 13/788,893 filed Mar. 7, 2013 in the name of Akie Shimizu et al.

Feb. 4, 2014 Office Action issued in Japanese Patent Application No. 2012-055103 (with English Translation).

Mar. 4, 2014 Office Action issued in U.S. Appl. No. 13/788,979.

* cited by examiner

FIG. 16

641

| IDENTIFICATION INFORMATION | X COORDINATE | Y COORDINATE |
|---|---|---|
| 111 | Px | Py |
| 112 | Qx | Qy |
| 113 | Rx | Ry |
| 114 | Sx | Sy |

SEWING MACHINE

CROSS-REFERENCE TO RELATED APPLICATION

This application claims priority to Japanese Patent Application No. 2012-055109, filed Mar. 12, 2012, the content of which is hereby incorporated herein by reference in its entirety.

BACKGROUND

The present disclosure relates to a sewing machine that is capable of performing sewing at a designated position on a work cloth.

A sewing machine is known that can set a sewing position and a sewing angle where a desired embroidery pattern to be sewn on a work cloth. For example, a sewing machine that is provided with an image capture portion uses the image capture portion to capture an image of a marker that an operator has affixed to the work cloth in a designated position. Based on the captured image of the marker, the sewing machine automatically sets the sewing position and the sewing angle for the embroidery pattern.

SUMMARY

However, in order for the sewing machine that is described above to set the sewing position and the sewing angle automatically, it is necessary for the operator to affix the marker to the work cloth. Moreover, after the sewing machine has set the sewing position and the sewing angle for the embroidery pattern, the sewing machine cannot perform the sewing if the operator does not peel off the marker that is affixed to the work cloth. Therefore, cases occur in which the work of affixing the marker to the work cloth and peeling the affixed marker off of the work cloth is burdensome for the operator.

The present disclosure provides a sewing machine on which the operator can easily set the position on the work cloth where the sewing to be performed.

Embodiments provide a sewing machine includes a detector, a processor, and a memory. The detector is configured to detect ultrasonic waves transmitted from a specification-enabled area. The memory stores non-transitory computer-readable instructions that instruct the sewing machine to perform specifying a prescribed position based on a positional relationship between a transmission area and the specification-enabled area, the transmission area being an area that is at least a portion of a sewing-enabled area and being an area that includes a position of a transmission source that transmits the ultrasonic waves, the prescribed position being a position of an embroidery frame when the entire transmission area is included in the specification-enabled area, the embroidery frame being configured to be mountable in the sewing machine and configured to hold a work cloth, and the sewing-enabled area being an area in which the sewing machine is able to perform sewing on the work cloth that is held by the embroidery frame, moving the embroidery frame to the specified prescribed position, specifying a transmission position based on the ultrasonic waves that are detected by the detector, the transmission position being a position of the transmission source that transmits the ultrasonic waves, and performing a sewing operation based on the specified transmission position, the sewing operation being an operation by which the sewing machine performs the sewing on the work cloth that is held by the embroidery frame.

BRIEF DESCRIPTION OF THE DRAWINGS

Embodiments will be described below in detail with reference to the accompanying drawings in which:

FIG. 16 is an explanatory figure of a table.

DETAILED DESCRIPTION

Figure 1:
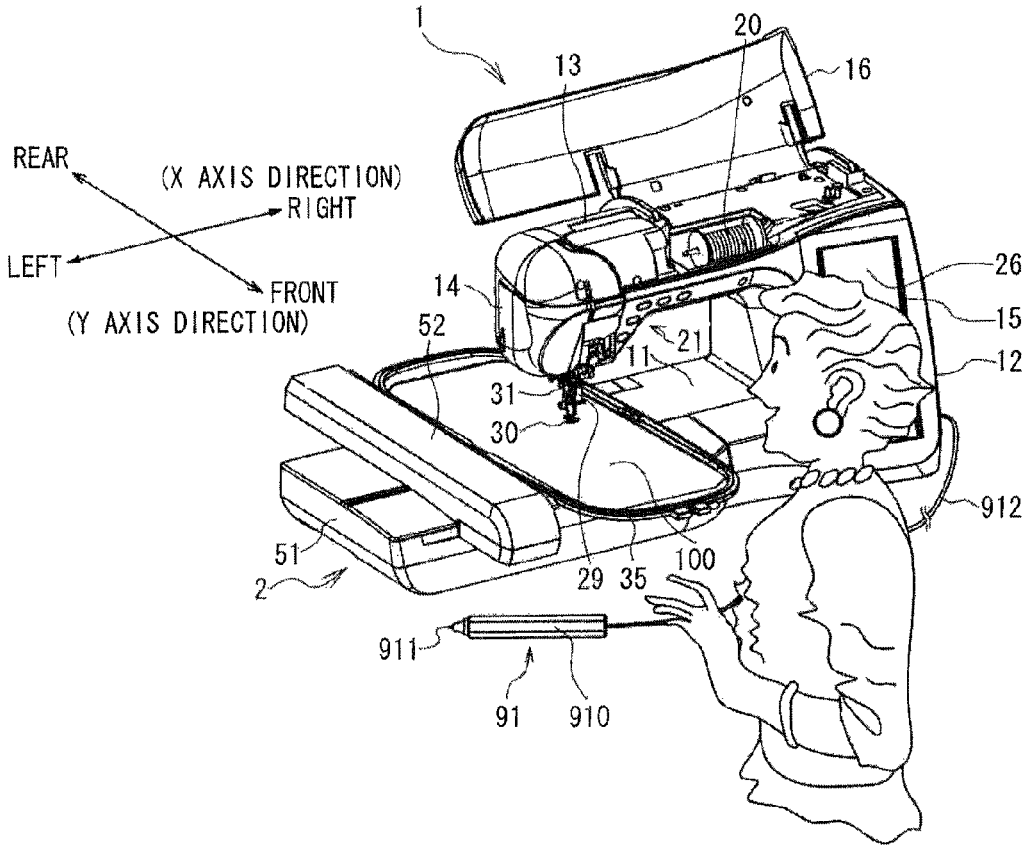
FIG. 1 is a perspective view of a sewing machine on which an embroidery device is mounted.

Hereinafter, an embodiment of the present disclosure will be explained with reference to the drawings. The configuration of a sewing machine 1 will be explained with reference to FIGS. 1 and 2. The top side, the bottom side, the left side, and the right side in FIG. 2 respectively correspond to the top side, the bottom side, the left side, and the right side of the sewing machine 1. A side on which operation switches 21 are provided is defined as the front side of the sewing machine 1.

The sewing machine 1 includes a bed 11, a pillar 12, an arm 13, and a head 14. The bed 11 is a base portion of the sewing machine 1, and the bed 11 extends in the left-right direction. The pillar 12 extends upward from the right end portion of the bed 11. The arm 13 extends to the left from the upper end of the pillar 12 such that the arm 13 is opposite of the bed 11. The head 14 is located on the left end of the arm 13. A needle plate 34 (refer to FIG. 2) is disposed on the top face of the bed 11. A feed dog (not shown in the drawings), a feed mechanism (not shown in the drawings), a shuttle mechanism (not shown in the drawings), and a feed adjustment motor 83 (refer to FIG. 6) are provided underneath the needle plate 34 (that is, inside the bed 11). The feed dog may be driven by the feed mechanism and move a work cloth by a specified feed amount. The feed amount for the feed dog may be adjusted by the feed adjustment motor 83. Note that the feed dog is not operated in a case where an embroidery device 2 is mounted on the sewing machine 1 and used, as will be described later.

A needle bar 29 and a presser bar 31 extend downward from the lower end of the head 14. A sewing needle (not shown in the drawings) can be attached to the lower end of the needle bar 29. A presser foot 30 can be attached to the lower end of the presser bar 31. The presser foot 30 may press on a work cloth 100. A needle bar mechanism (not shown in the drawings), a swinging mechanism (not shown in the drawings), and a swinging motor 80 (refer to FIG. 6) are provided in the head 14. The needle bar mechanism may move the needle bar 29 up and down. A sewing machine motor 79 (refer to FIG. 6) may drive the needle bar mechanism. The swinging mechanism may swing the needle bar 29 to the left and to the right. The swinging motor 80 may drive the swinging mechanism.

In the present disclosure, the sewing machine 1 is used in a state in which the embroidery device 2 has been mounted on the sewing machine 1. The embroidery device 2 can be mounted on and removed from the bed 11 of the sewing machine 1. The embroidery device 2 includes a body 51 and a carriage 52. When the embroidery device 2 is mounted on the sewing machine 1, the embroidery device 2 and the sewing machine 1 are electrically connected.

The carriage 52 is provided on the top side of the body 51. The carriage 52 has a rectangular shape that is long in the front-rear direction. The carriage 52 includes a frame holder 55, a Y axis moving mechanism (not shown in the drawings), and a Y axis motor 87 (refer to FIG. 6). The frame holder 55 is a holder on which an embroidery frame 35 (refer to FIG. 1) can be removably mounted. An embroidery frame of a size and shape that are different from those of the embroidery frame 35 can also be mounted on and removed from the frame holder 55. As an example, an embroidery frame 36 (refer to FIG. 13) with a different (smaller) size can be mounted on and removed from the frame holder 55 instead of the embroidery frame 35. The frame holder 55 is provided on the right side face of the carriage 52. As shown in FIG. 1, the embroidery frame 35 has a known structure. The embroidery frame 35 is configured to hold the work cloth 100 by clamping the work cloth 100 between an inner frame and an outer frame, although this is not shown in detail in the drawings. The work cloth 100 that is held in the embroidery frame 35 may be positioned on the top side of the bed 11 and below the needle bar 29 and the presser foot 30. The Y axis moving mechanism may move the frame holder 55 in the front-rear direction (the Y axis direction). The moving of the frame holder 55 in the front-rear direction causes the embroidery frame 35 to move the work cloth 100 in the front-rear direction. The Y axis motor 87 may drive the Y axis moving mechanism. A CPU 61 (refer to FIG. 6) of the sewing machine 1 controls the Y axis motor 87.

An X axis moving mechanism (not shown in the drawings) and an X axis motor 86 (refer to FIG. 6) that may move the carriage 52 in the left-right direction (the X axis direction) are provided in the interior of the body 51. The moving of the carriage 52 in the left-right direction causes the embroidery frame 35 to move the work cloth 100 in the left-right direction. The X axis motor 86 may drive the X axis moving mechanism. The CPU 61 of the sewing machine 1 controls the X axis motor 86.

Figure 2:
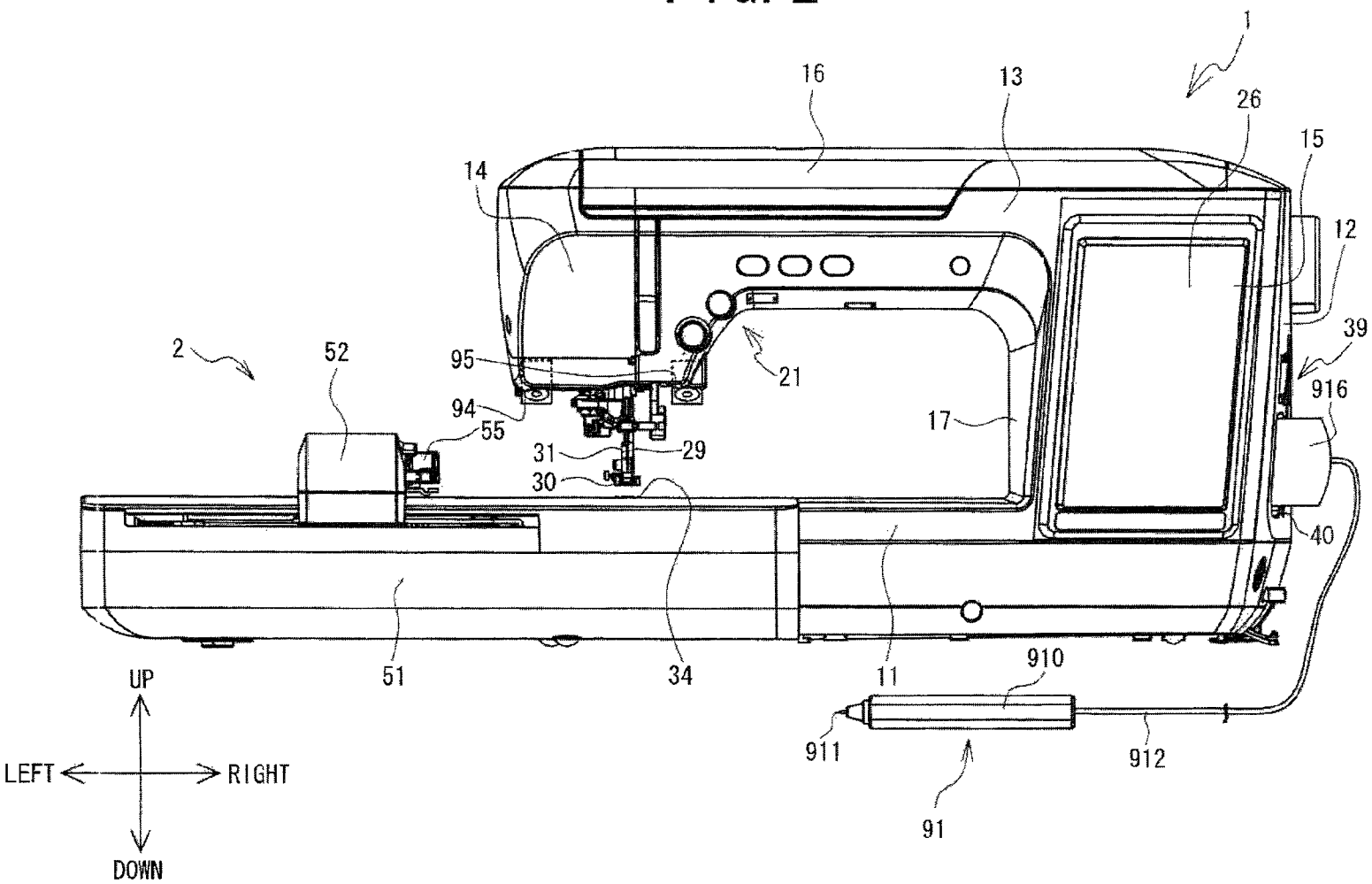
FIG. 2 is a front view of the sewing machine on which the embroidery device is mounted.

As shown in FIG. 2, receivers 94, 95 are provided on the rear portion of the lower end of the head 14. The receiver 94 and the receiver 95 have the identical structures. The receiver 94 is provided on the rear part of the bottom face of the head 14 at the lower left edge of the head 14. The receiver 95 is provided on the rear part of the bottom face of the head 14 at the lower right edge of the head 14. The receivers 94, 95 are separated from one another by the length of the head 14 in the left-right direction. The receivers 94, 95 are configured to detect ultrasonic waves. The receivers 94, 95 will be described in detail later.

As shown in FIG. 1, a cover 16 that can be opened and closed is provided in the upper portion of the arm 13. A spool 20 may be accommodated under the cover 16, that is, approximately in the central portion inside the arm 13. An upper thread (not shown in the drawings) that is wound around the spool 20 may be supplied from the spool 20 to the sewing needle that is attached to the needle bar 29, by way of a thread guard portion (not shown in the drawings) that is provided in the head 14. The operation switches 21, which include a start-and-stop switch, are provided in the lower portion of the front face of the arm 13.

A liquid crystal display (hereinafter called the LCD) 15 is provided on the front face of the pillar 12. A screen that includes various types of items, such as commands, illustrations, setting values, messages, and the like, may be displayed on the LCD 15. A touch panel 26 is provided on the front face of the LCD 15. By using a finger or a special touch pen to touch a location on the touch panel 26 that corresponds to an item that is displayed on the LCD 15, an operator can select a pattern to be sewn or a command to be executed. Hereinafter, an operation that the operator performs by using the touch panel 26 is referred to as a panel operation.

As shown in FIG. 2, connectors 39, 40 are provided on the right side face of the pillar 12. An external storage device (not shown in the drawings) such as a memory card or the like can be connected to the connector 39. The sewing machine 1 may acquire embroidery pattern data and various types of programs from the external storage device that is connected to the connector 39. A connector 916 is configured to be connected to the connector 40. The connector 916 is configured to be connected to a cable 912 that extends from an ultrasound pen 91 (described later). The sewing machine 1 may supply electric power to the ultrasound pen 91 through the connector 40, the connector 916, and the cable 912, and the sewing machine 1 may also acquire electrical signals that are output from the ultrasound pen 91.

The ultrasound pen 91 will be explained. The ultrasound pen 91 includes a pen body 910 and a pen tip 911. The shape of the pen body 910 is a bar shape. The pen tip 911 is provided on one end of the pen body 910. The tip of the pen tip 911 is pointed. The pen tip 911 is able to move between a projecting position and a retracted position. The projecting position is a position in which the pen tip 911 projects slightly to the outside of the pen body 910. In a state in which an external force is not acting on the pen tip 911, the pen tip 911 is positioned in the projecting position. When a force acts on the 911 that is in the projecting position in the direction toward the pen body 910, the pen tip 911 moves into the pen body 910, and the pen tip 911 shifts to the retracted position. When the force that is acting on the pen tip 911 ceases, the pen tip 911 returns to the projecting position.

A switch 913 (refer to FIG. 6), a signal output circuit 914 (refer to FIG. 6), and an ultrasound transmitter 915 (refer to FIG. 6) are provided inside the pen body 910. The switch 913 may switch between an ON state and an OFF state in accordance with the position of the pen tip 911. The switch 913 may switch the output states of the signal output circuit 914 and the ultrasound transmitter 915.

When the pen tip 911 is positioned in the projecting position, the switch 913 is in the OFF state. In a case where the switch 913 is in the OFF state, the signal output circuit 914 does not output an electrical signal, and the ultrasound transmitter 915 does not transmit ultrasonic waves. On the other hand, the pen tip 911 is shifted to the retracted position by the operator's pressing of the pen tip 911 against a desired position on the work cloth 100, for example. The switch 913 is switched to the ON state by the positioning of the pen tip 911 in the retracted position. When the switch 913 is in the ON state, the signal output circuit 914 outputs an electrical signal to the sewing machine 1 through the cable 912, and the ultrasound transmitter 915 transmits ultrasonic waves.

Note that the sewing machine 1 may use the receivers 94, 95 to detect (receive) the ultrasonic waves that are transmitted from the ultrasound pen 91, although this will be described in detail later. Based on the detected ultrasonic waves, the sewing machine 1 may specify the position of the transmission source of the ultrasonic waves, that is, the ultrasound transmitter 915 that is provided in the ultrasound pen 91. The sewing machine 1 may perform sewing based on the specified position.

The receiver 94 will be explained with reference to FIGS. 3 to 5. The receiver 95 has an identical structure to that of the receiver 94. Therefore, an explanation of the receiver 95 will be omitted. The lower left side, the upper right side, the upper left side, the lower right side, the top side, and the bottom side in FIG. 3 respectively define the front side, the rear side, the left side, the right side, the top side, and the bottom side of the receiver 94.

Figure 3:
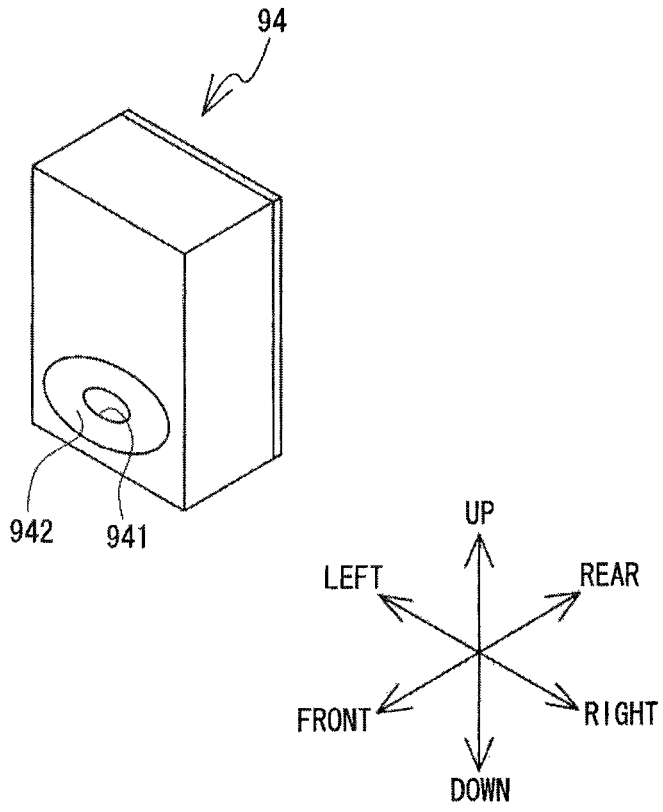
FIG. 3 is a perspective view of a receiver.
Figure 4:
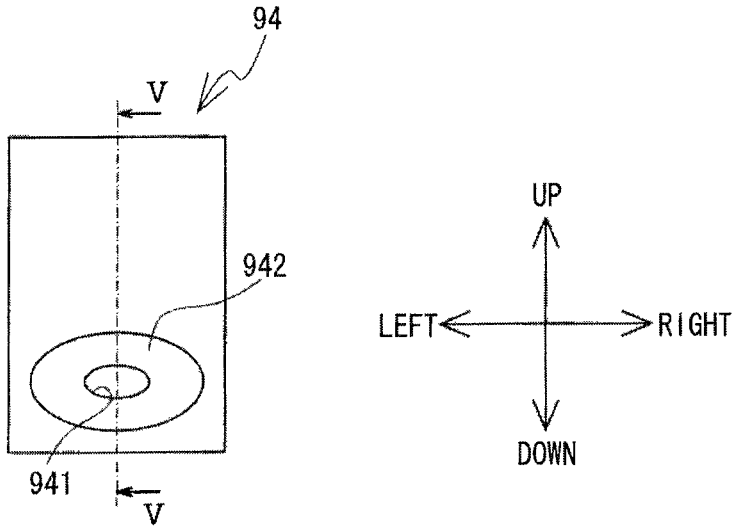
FIG. 4 is a front view of the receiver.
Figure 5:
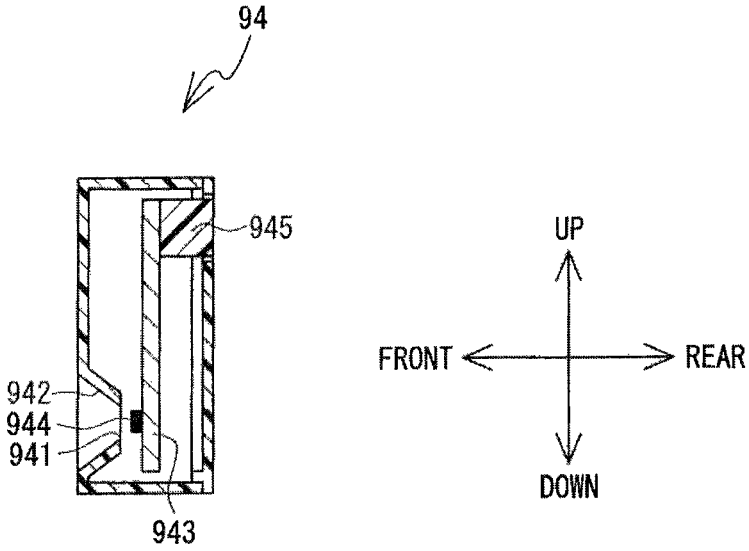
FIG. 5 is a section view of the receiver in the direction of a line V-V that is shown in FIG. 4.

As shown in FIGS. 3 and 4, the shape of the receiver 94 is a rectangular parallelepiped shape that is slightly longer in the up-down direction. The receiver 94 is provided with an opening 941 in the center of the lower portion of front face of the receiver 94. The shape of the opening 941 is an ellipse whose long axis extends in the left-right direction. A surrounding portion 942 that is a portion that surrounds the opening 941 is a tapered surface (an inclined surface) that becomes larger toward the front side. As shown in FIG. 5, a panel 943 and a microphone 944 are provided in the interior of the receiver 94. The microphone 944 is positioned on the inner side of the opening 941. As shown in FIG. 5, a connector 945 is mounted on the rear face of the upper end of the panel 943. The connector 945 is configured to be connected to a connector (not shown in the drawings) that is provided in the sewing machine 1.

Figure 6:
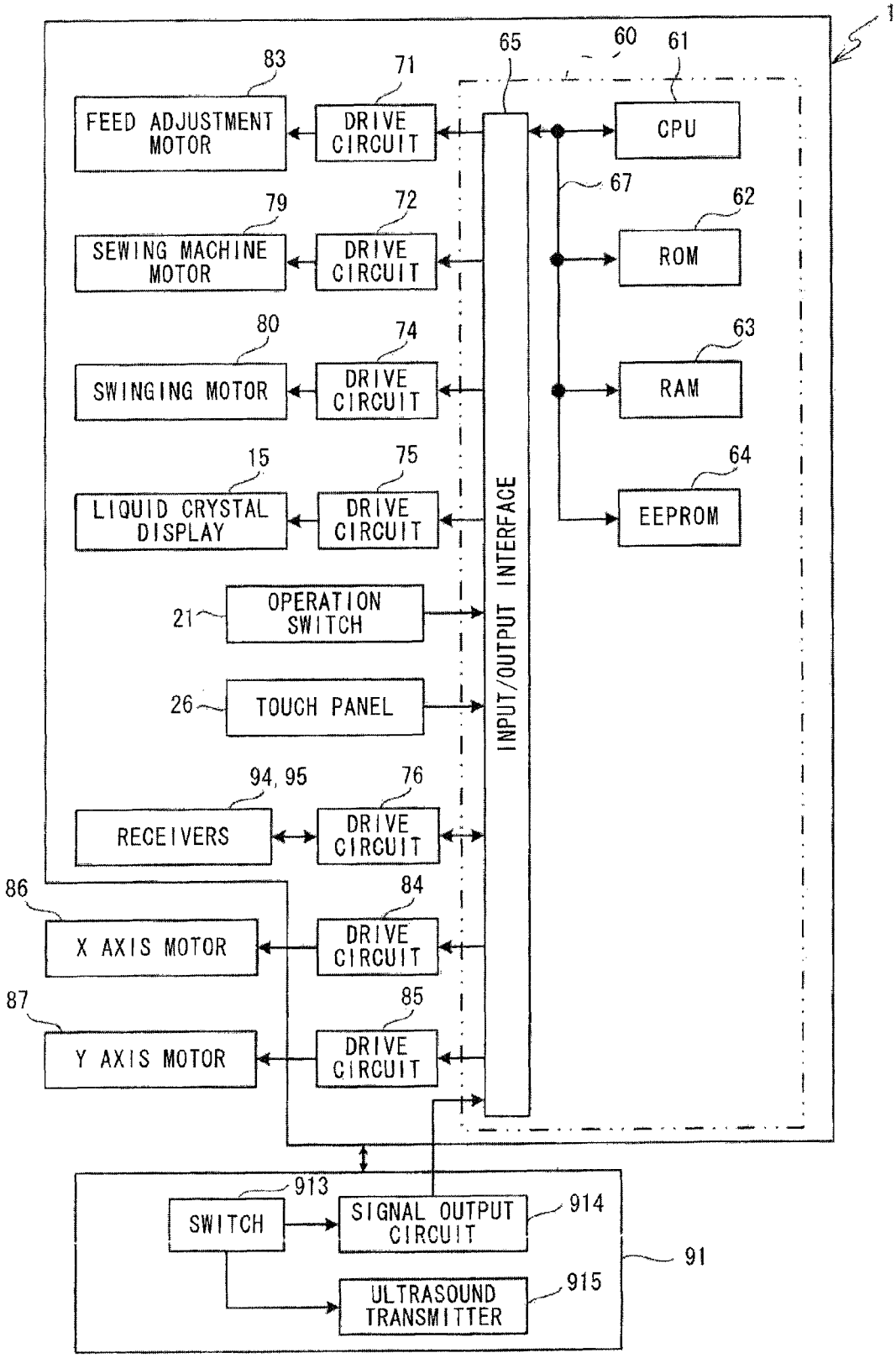
FIG. 6 is a block diagram that shows an electrical configuration of the sewing machine.

The electrical configuration of the sewing machine 1 will be explained with reference to FIG. 6. A control portion 60 of the sewing machine 1 includes the CPU 61, a ROM 62, a RAM 63, an EEPROM 64, and an input/output interface 65. The CPU 61, the ROM 62, the RAM 63, the EEPROM 64, and the input/output interface 65 are connected to one another through a bus 67. Programs that the CPU 61 may use to perform processing, data for a plurality of types sewing patterns that the sewing machine 1 may use to perform sewing, as well as data and the like, are stored in the ROM 62. Data that indicate settings of the sewing machine 1 and the like are stored in the EEPROM 64.

The operation switches 21, the touch panel 26, and drive circuits 71, 72, 74, 75, 76, 84, 85 are electrically connected to the input/output interface 65. The drive circuits 71, 72, 74, 75, 76, 84, 85 may respectively drive the feed adjustment motor 83, the sewing machine motor 79, the swinging motor 80, the LCD 15, the receivers 94, 95, the X axis motor 86, and the Y axis motor 87. An amplifier circuit that is included in the drive circuit 76 may amplify and transmit to the CPU 61 the ultrasonic wave signals that are detected by the receivers 94, 95.

The electrical configuration of the ultrasound pen 91 will be explained. The ultrasound pen 91 includes the switch 913, the signal output circuit 914, and the ultrasound transmitter 915. The switch 913 is configured to be connected to the signal output circuit 914 and the ultrasound transmitter 915. The signal output circuit 914 is configured to be connected to the input/output interface 65. The signal output circuit 914 may output electrical signals to the CPU 61 through the input/output interface 65.

Figure 7:
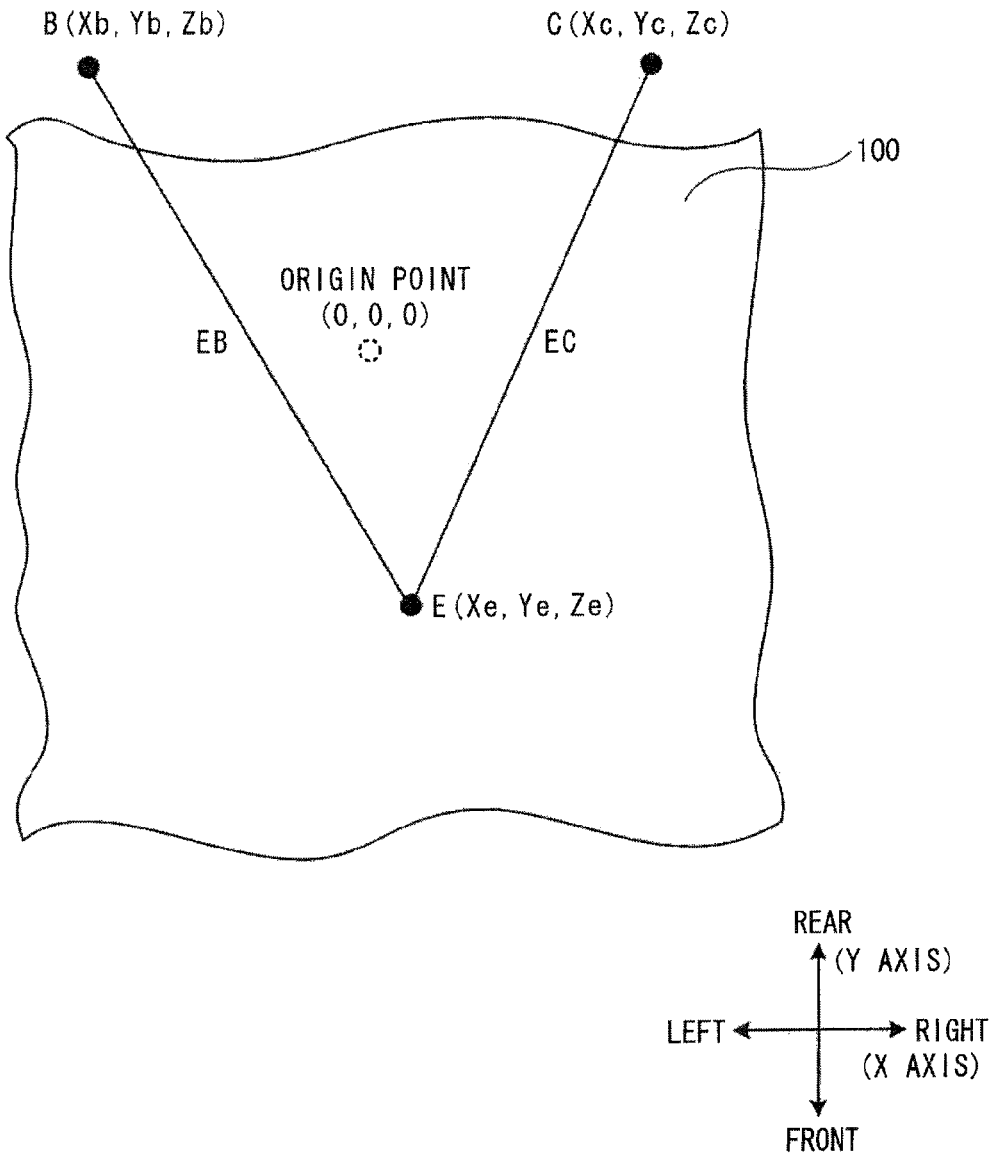
FIG. 7 is an explanatory figure of a method for computing designated coordinates.

A method for specifying a position on the work cloth 100 that is designated by the ultrasound pen 91 will be explained with reference to FIG. 7. By pressing the pen tip 911 of the ultrasound pen 91 against the work cloth 100, the operator can designate a specific position on the work cloth 100. Hereinafter, the position on the work cloth 100 against which the pen tip 911 of the ultrasound pen 91 has been pressed is referred to as a designated position. Note that, as will be described later, the sewing machine 1 can specify the designated position by specifying the position of the transmission source of the ultrasonic waves. Therefore, in a precise sense, the position that is specified as the designated position is not the position on the work cloth 100 against which the pen tip 911 is pressed, but is the position of the ultrasound transmitter 915 that is provided in the ultrasound pen 91. However, the pen tip 911 and the ultrasound transmitter 915 are located extremely close to one another. Therefore, in the present embodiment, the position of the ultrasound transmitter 915 is regarded as the position on the work cloth 100 against which the pen tip 911 is pressed, that is, as the designated position. Hereinafter, the left-right direction, the front-rear direction, and the up-down direction in the sewing machine 1 are respectively defined as the X axis direction, the Y axis direction, and the Z axis direction. The left-right direction and the up-down direction in FIG. 7 are respectively equivalent to the X axis direction and the Y axis direction.

The sewing machine 1 may specify the designated position in the form of coordinate information (an X coordinate, a Y coordinate, and a Z coordinate). In the present embodiment, an example is used in which the origin point (0, 0, 0) of the coordinate system is the center point of a hole (a needle hole) through which the sewing needle may pass. The needle hole is formed in the needle plate 34 (refer to FIG. 2). The plane on which the Z coordinate is zero is equivalent to the top face of the needle plate 34. Coordinates B that indicate the position of the receiver 94 are defined as (Xb, Yb, Zb). Coordinates C that indicate the position of the receiver 95 are defined as (Xc, Yc, Zc). Coordinates E that indicate the designated position are defined as (Xe, Ye, Ze). The respective Z coordinates of the receivers 94, 95 indicate the heights of the receivers 94, 95 in relation to the top face of the needle plate 34. The coordinates B (Xb, Yb, Zb) and the coordinates C (Xc, Ye, Zc) are stored in the ROM 62 in advance. Hereinafter, the coordinates E are referred to as the designated coordinates E. The distance between the designated coordinates E and the coordinates B is referred to as the distance EB. The distance between the designated coordinates E and the coordinates C is referred to as the distance EC.

Based on the Pythagorean theorem, the distances EB, EC can be described by the coordinates B, C, E. The relationship between the distance EB and the coordinates B, C, E is described by Equation (1) below. In the same manner, the relationship between the distance EC and the coordinates B, C, E is described by Equation (2) below.

$$(Xb-Xe)^2+(Yb-Ye)^2+(Zb-Ze)^2=(EB)^2 \quad (1):$$

$$(Xc-Xe)^2+(Yc-Ye)^2+(Zc-Ze)^2=(EC)^2 \quad (2):$$

Note that Equation (1) is identical to an equation for a spherical surface (with a radius of the distance EB) for which the coordinates B define the origin point and that intersects the designated coordinates E. In the same manner, Equation (2) is identical to an equation for a spherical surface (with a radius of the distance EC) for which the coordinates C define the origin point and that intersects the designated coordinates E.

The velocity at which ultrasonic waves travel is referred to as the velocity of sound V. The time that is required for the ultrasonic waves that are transmitted from the ultrasound pen 91 that is at the designated coordinates E to arrive at the receiver 94 is referred to as a transmission time Tb. The time that is required for the ultrasonic waves that are transmitted from the ultrasound pen 91 that is at the designated coordinates E to arrive at the receiver 95 is referred to as a transmission time Tc. In this case, the distances EB, EC can respectively be described by Equations (3) and (4) below.

$$EB=V\times Tb \quad (3):$$

$$EC=V\times Tc \quad (4):$$

Substituting Equations (3) and (4) into Equations (1) and (2) yields Equations (5) and (6) below.

$$(Xb-Xe)^2+(Yb-Ye)^2+(Zb-Ze)^2=(V\times Tb)^2 \quad (5):$$

$$(Xc-Xe)^2+(Ye-Ye)^2+(Zc-Ze)^2=(V\times Tc)^2 \quad (6):$$

In Equations (5) and (6), the coordinates B (Xb, Yb, Zb), the coordinates C (Xc, Ye, Zc) and the velocity of sound V are known values, and each of those values has been stored in the ROM 62. The transmission times Tb, Tc may be specified by computing the difference between the time that the ultrasonic waves are transmitted from the ultrasound transmitter 915 of the ultrasound pen 91 and the time that the ultrasonic waves are detected by the receivers 94, 95. Hereinafter, the time when the ultrasonic waves are transmitted from the ultrasound transmitter 915 of the ultrasound pen 91 is referred to as the transmission time T1. The pair of times when the ultrasonic waves are detected by the receivers 94, 95, respectively, are referred to as the detection times T2. Among the designated coordinates E (Xe, Ye, Ze), Ze is a value that is determined by the thickness of the work cloth 100. Therefore, the range of values that Ze can have is smaller than the ranges of values that Xe and Ye can respectively have. Therefore, in the present embodiment, the value of Ze is regarded as being zero. Accordingly, the respective values for Xe and Ye are computed by solving the simultaneous Equations (5) and (6). In this manner, the designated coordinates E (Xe, Ye, Ze (=0)) that the operator has used the ultrasound pen 91 to designate on the work cloth 100 may be computed.

In the present embodiment, the designated position that the sewing machine 1 is capable of specifying accurately by the method that is described above lies within a specification-enabled area 101 of the work cloth 100 that is held by the embroidery frame 35. The reason for this will be explained. The received strength of the ultrasonic waves attenuate with increasing the distance between the position of the ultrasound pen 91 (the ultrasound transmitter 915) and the receivers 94, 95. Therefore, depending on the distance between the position of the ultrasound pen 91 and the receivers 94, 95, cases may occur in which the receivers 94, 95 are unable to receive the ultrasonic waves with sufficient accuracy. Furthermore, the receiving sensitivity of the receivers 94, 95 has directionality in a specific direction. Therefore, cases may occur in which the receivers 94, 95 are unable to receive the ultrasonic waves with sufficient accuracy, depending on the position of the ultrasound pen 91 (the ultrasound transmitter 915). In a case where the receivers 94, 95 are unable to receive the ultrasonic waves with sufficient accuracy, the sewing machine 1 is not able to specify the designated position accurately.

The specification-enabled area 101 is shown in FIGS. 8 to 14. The specification-enabled area 101 is an area that is defined as an area within which the sewing machine 1 is able to specify the designated position accurately. In the present embodiment, the specification-enabled area 101 is defined as a square area. Coordinate information that indicates the positions of the four vertices of the specification-enabled area 101 is stored in the ROM 62. In FIGS. 8 to 14, in order to facilitate the explanation, the sewing machine 1 is not shown, and the embroidery device 2 and the embroidery frame 35 that are mounted in the sewing machine 1 are shown. In a case where a position within the specification-enabled area 101 is designated by the ultrasound pen 91, the receivers 94, 95 are able to receive the ultrasonic waves with sufficient accuracy. In this case, the sewing machine 1 is able to specify the designated position accurately. On the other hand, in a case where a position outside the specification-enabled area 101 is designated by the ultrasound pen 91, the receivers 94, 95 are not able to receive the ultrasonic waves with sufficient accuracy. In this case, the sewing machine 1 cannot specify the designated position accurately.

A needle drop point 102 is a position within the specification-enabled area 101. The needle drop point 102 is positioned near the rear edge of the specification-enabled area 101 and approximately in the center in the left-right direction. That is, the portion of the specification-enabled area 101 that is to the front of the needle drop point 102 is larger than the portion that is to the rear of the needle drop point 102. That is, a front area that is on front side of a boundary line (not shown in the drawings) is larger than a rear area that is on rear side of the boundary line. The boundary line is a line that passes through the needle drop 102 point and extends in the left-right direction. Hereinafter, in order to facilitate the explanation, the specification-enabled area 101 is also referred to as a front side area that includes the needle drop point 102. The needle drop point 102 is the point where the sewing needle may pierce the work cloth 100, that is, the center point of the needle hole that is formed in the needle plate 34, and the needle drop point 102 is coincident with the center of the needle bar 29. The length of the specification-enabled area 101 in the front-rear direction is slightly shorter than one-half of the length of the embroidery frame 35 in the front-rear direction. The length of the specification-enabled area 101 in the left-right direction is slightly shorter than the length of the embroidery frame 35 in the left-right direction.

The reason why the specification-enabled area 101 is the front side area that includes the needle drop point 102 will be explained. As shown in FIG. 1, the operation switches 21, the LCD 15, and the like are provided on the front face of the sewing machine 1. Therefore, the operator may operate the sewing machine 1 from the front side of the sewing machine 1. The operator may bring the ultrasound pen 91 close to the work cloth 100 from the front side of the sewing machine 1 and presses the pen tip 911 against the work cloth 100. In a case where the specification-enabled area 101 is positioned to the rear of the needle drop point 102, the operator use the ultrasound pen 91 to designate a position within the specification-enabled area 101 while avoiding the needle bar 29 and the presser bar 31. In addition, the head 14 and the arm 13 interfere with the operator's view of the specification-enabled area 101. In other words, in a case where the specification-enabled area 101 is positioned to the rear of the needle drop point 102, it is extremely difficult for the operator to designate a position within the specification-enabled area 101. On the other hand, in the present embodiment, the specification-enabled area 101 is the front side area that includes the needle drop point 102. Therefore, in the present embodiment, a position on the work cloth 100 that can be designated by the ultrasound pen 91 is a position that is located to the front of the needle drop point 102. Thus, comparing to the case in which the specification-enabled area 101 is positioned to the rear of the needle drop point 102, the operator can easily designate a position within the specification-enabled area 101.

Figure 8:
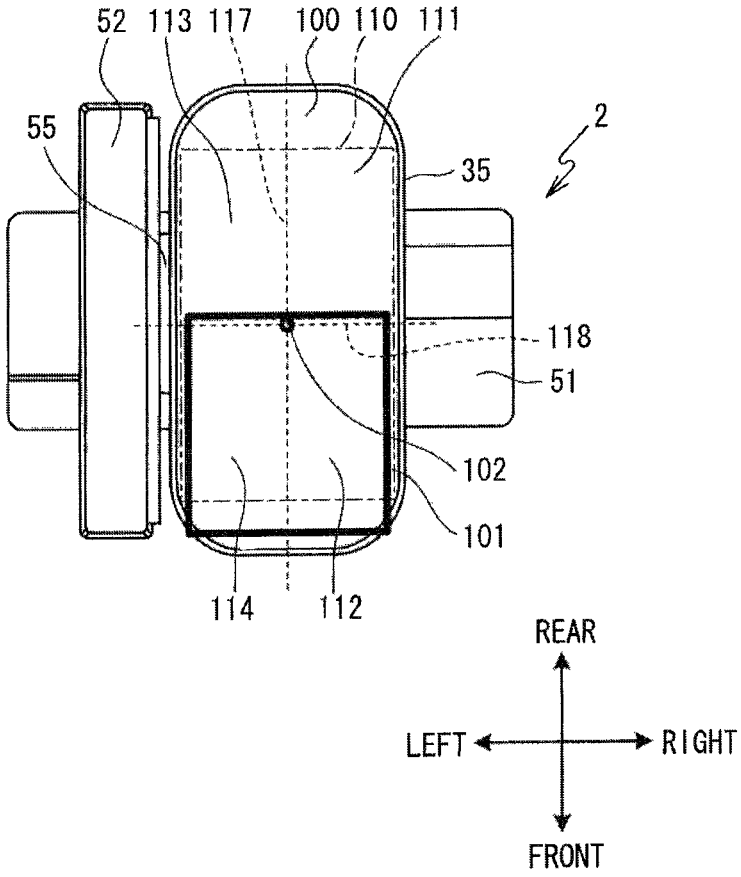
FIG. 8 is an explanatory figure of the embroidery device, on which an embroidery frame is mounted, and a specification-enabled area.

A square area that is bounded by a dashed-dotted line that is shown on the work cloth 100 that is held by the embroidery frame 35 indicates a sewing-enabled area 110 (refer to FIG. 8). The sewing-enabled area 110 is an area in which the sewing machine 1 is able to perform the sewing of an embroidery pattern on the work cloth 100 that is held by the embroidery frame 35. The sewing-enabled area 110 is defined such that size of the sewing-enabled area 110 is slightly smaller than that of the embroidery frame 35. Coordinate information that describes the sewing-enabled area 110 is stored in the ROM 62 in association with information that indicates the type of the embroidery frame 35, for example. The CPU 61 specifies the type of the embroidery frame 35 that is mounted in the sewing machine 1, for example, and then specifies the coordinate information that describes the sewing-enabled area 110 and is stored in association with the information that indicates the specified type of the embroidery frame 35. A method for specifying the type of the embroidery frame 35 that is mounted in the sewing machine 1 will be described later. The coordinate information that indicates the position of the sewing-enabled area 110 may be, for example, coordinate information that indicates the positions of the four vertices of the sewing-enabled area 110 when the embroidery frame 35 is positioned in an initial position. The initial position will be described later. A length that is one-half of the length of the sewing-enabled area 110 in the front-rear direction is shorter than the length of the specification-enabled area 101 in the front-rear direction. The length of the sewing-enabled area 110 in the left-right direction is slightly longer than the length of the specification-enabled area 101 in the left-right direction.

The sewing-enabled area 110 is divided into four sub-areas by line segments 117, 118. The line segments 117, 118 are line segments that each connect the midpoints of opposite sides of the sewing-enabled area 110. Among the four sub-areas, the right rear sub-area, the right front sub-area, the left rear sub-area, and the left front sub-area are respectively defined as sub-areas 111, 112, 113, 114. In FIG. 8, the needle drop point 102 is located at the point of intersection of the line segments 117, 118, that is, at the center of the embroidery frame 35. Hereinafter, the position of the embroidery frame 35 in a state in which the needle drop point 102 is located at the center of the embroidery frame 35 is defined as the initial position. Portions of the sub-areas 112, 114 overlap a portion of the specification-enabled area 101. The right edge of the sub-area 112 is positioned to the right of the right edge of the specification-enabled area 101. Similarly, the left edge of the sub-area 114 is positioned to the left of the left edge of the specification-enabled area 101.

In the state that is shown in FIG. 8, in a case where the operator uses the ultrasound pen 91 to designate a position within the sub-area 111, for example, the sub-area 111 is located outside the specification-enabled area 101. Therefore, the receivers 94, 95 are not able to accurately receive the ultrasonic waves that are transmitted from the designated position within the sub-area 111. In this case, the operator may use a panel operation to designate the sub-area 111, which includes the position that the operator designates by using the ultrasound pen 91. The sewing machine 1 may control the embroidery device 2 to move the embroidery frame 35 such that the designated sub-area 111 is accommodated within the specification-enabled area 101. Accordingly, the receivers 94, 95 can receive with sufficient accuracy the ultrasonic waves that the ultrasound pen 91 transmits from its position within the sub-area 111. Accordingly, the sewing machine 1 can accurately specify the designated position. This will be explained in detail.

In a case where, for example, the operator has designated the sub-area 111 as the area that includes the position that is designated by the ultrasound pen 91, the sewing machine 1, by operating the X axis motor 86, controls the X axis moving mechanism such that the embroidery frame 35 is moved to the left from the initial position. By also operating the Y axis motor 87, the sewing machine 1 controls the Y axis moving mechanism such that the embroidery frame 35 is moved toward the front from the initial position. The embroidery frame 35 is thus moved obliquely to the left and toward the front from the initial position (refer to FIG. 8), and the sub-area 111 is accommodated within the specification-enabled area 101 (refer to FIG. 9).

Figure 10:
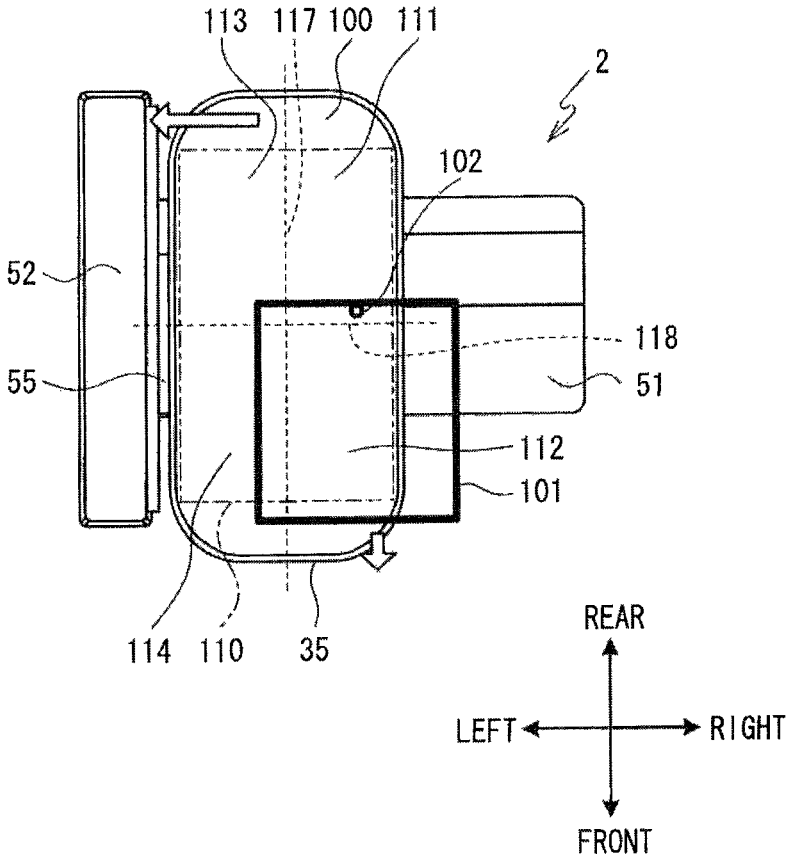
FIG. 10 is an explanatory figure of the embroidery device on which the embroidery frame is mounted and the specification-enabled area.
Figure 11:
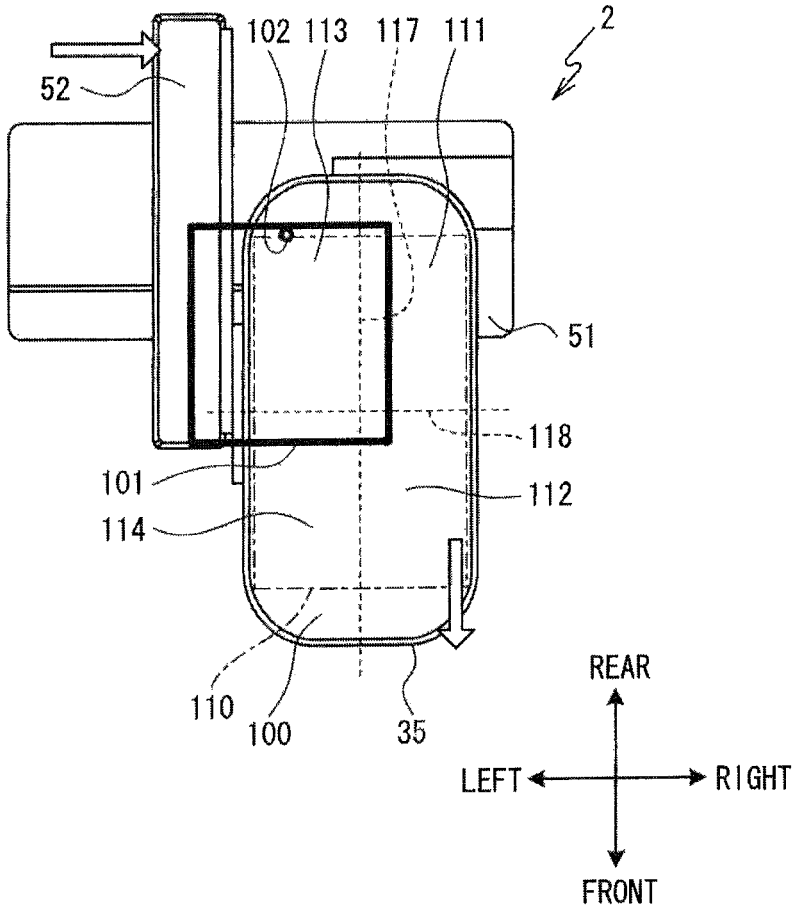
FIG. 11 is an explanatory figure of the embroidery device on which the embroidery frame is mounted and the specification-enabled area.
Figure 12:
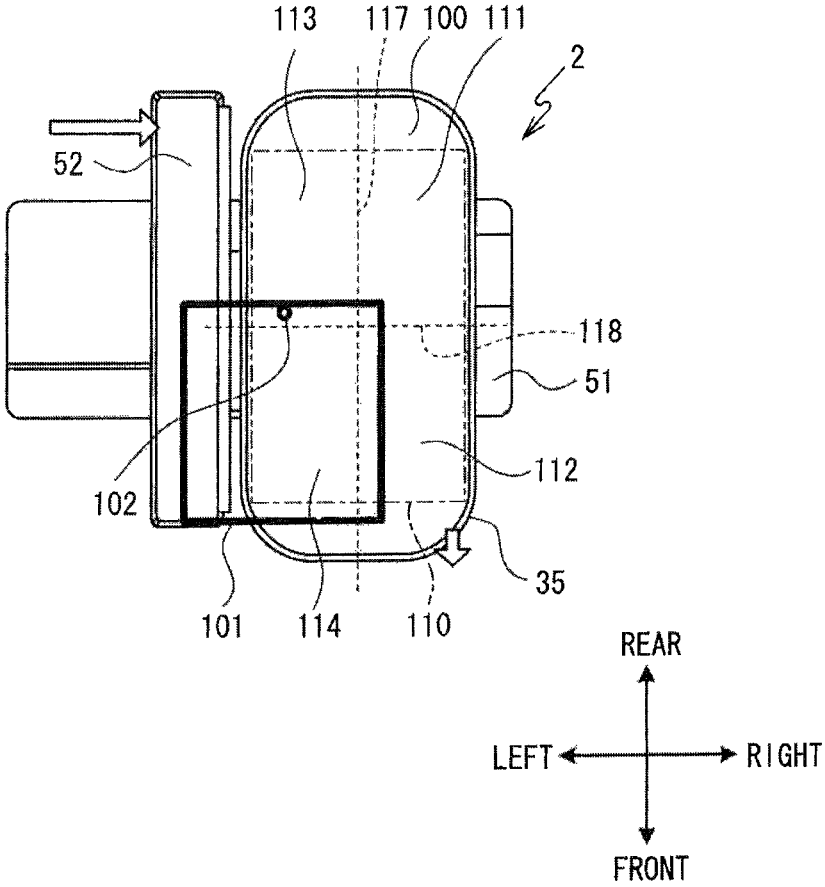
FIG. 12 is an explanatory figure of the embroidery device on which the embroidery frame is mounted and the specification-enabled area.

Furthermore, in a case where the operator uses a panel operation to designate one of the sub-areas 112, 113, 114 as the area that includes the position that is designated by the ultrasound pen 91, the embroidery frame 35 is moved in the same manner, and the designated one of the sub-areas 112, 113, 114 is accommodated within the specification-enabled area 101 (refer to FIGS. 10 to 12).

The sub-area that includes the position that the operator wants the position to be the designated position is positioned within the specification-enabled area 101 by the moving of the embroidery frame 35 as described above. The operator uses the pen tip 911 of the ultrasound pen 91 to designate the position on the work cloth 100 that the operator wants the position to be the designated position. The pen tip 911 of the ultrasound pen 91 is pressed against the work cloth 100, and the ultrasound transmitter 915 transmits the ultrasonic waves. At this time, the ultrasonic waves are transmitted from within the specification-enabled area 101. Therefore, the receivers 94, 95 are able to receive the ultrasonic waves with sufficient accuracy. Accordingly, the sewing machine 1 specifies the designated position accurately and performs the sewing based on the specified designated position.

As described above, by using the ultrasound pen 91, the operator can easily and accurately perform the designating of the desired position on the work cloth 100. By controlling the embroidery device 2 in accordance with a command issued by a panel operation, the sewing machine 1 may move the embroidery frame 35 such that the receivers 94, 95 are able to receive the ultrasonic waves with sufficient accuracy. Thus, the sewing machine 1 is able to specify the designated position accurately and perform the sewing in any case where a position within the sewing-enabled area 110 on the work cloth 100 is designated by the ultrasound pen 91.

Figure 13:
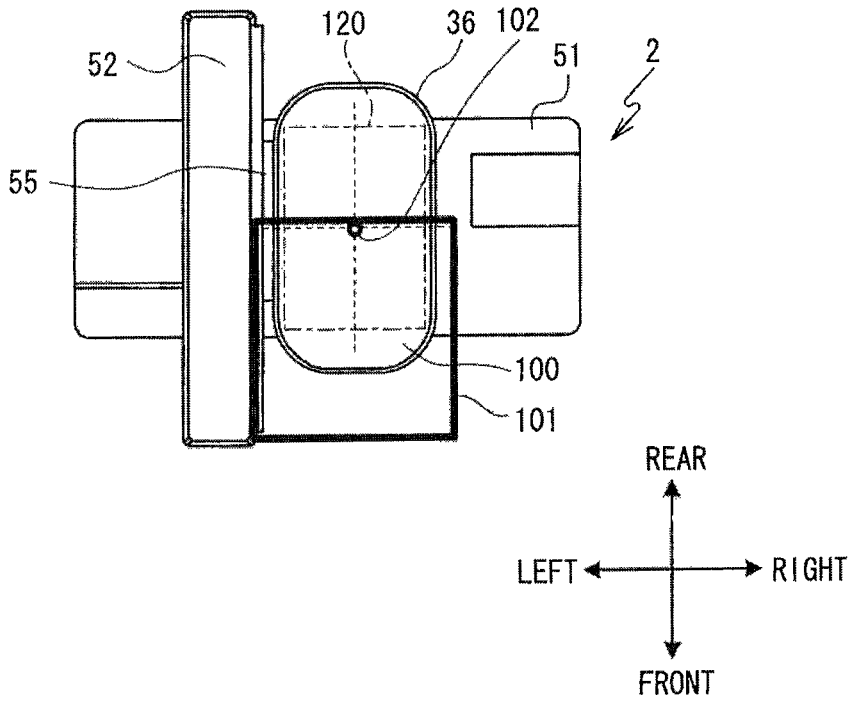
FIG. 13 is an explanatory figure of the embroidery device on which the embroidery frame is mounted and the specification-enabled area.
Figure 14:
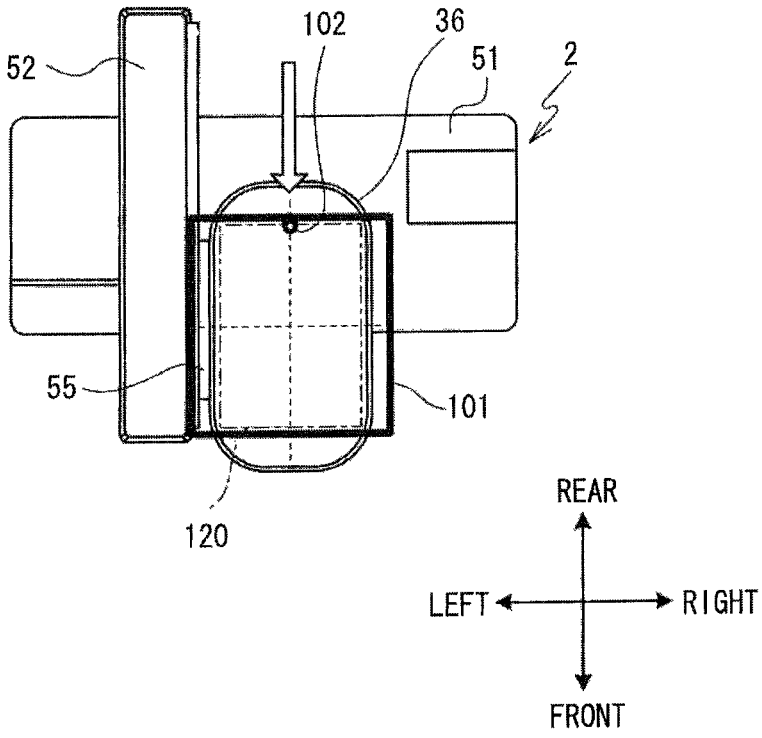
FIG. 14 is an explanatory figure of the embroidery device on which the embroidery frame is mounted and the specification-enabled area.

Next, a case will be explained, with reference to FIGS. 13 and 14, in which an embroidery frame 36 that is smaller than the embroidery frame 35 is mounted on the embroidery device 2 and used. As shown in FIG. 13, the lengths of the embroidery frame 36 in the front-rear direction and the left-right direction are respectively about two-thirds of the lengths of the embroidery frame 35 (refer to FIG. 8 and the like) in the front-rear direction and the left-right direction. The length of the specification-enabled area 101 in the front-rear direction is longer than one-half of the length of the embroidery frame 36 in the front-rear direction. The length of the specification-enabled area 101 in the left-right direction is longer than the length of the embroidery frame 36 in the left-right direction.

A rectangular sewing-enabled area 120 of the work cloth 100 that is held by the embroidery frame 36 is shown in FIGS.

13 and 14. The length of the sewing-enabled area 120 in the front-rear direction is slightly shorter than the length of the specification-enabled area 101 in the front-rear direction. The length of the sewing-enabled area 120 in the left-right direction is shorter than the length of the specification-enabled area 101 in the left-right direction. That is, the specification-enabled area 101 is a larger area than the sewing-enabled area 120. Therefore, unlike the case where the embroidery frame 35 is mounted on the embroidery device 2, the sewing machine 1 controls the embroidery device 2 to move the embroidery frame 36 such that the entire sewing-enabled area 120 is accommodated within the specification-enabled area 101, as shown in FIG. 14. The accommodating of the entire sewing-enabled area 120 within the specification-enabled area 101 makes it possible for the receivers 94, 95 to receive with sufficient accuracy the ultrasonic waves that are transmitted from the ultrasound pen 91, regardless of the position within the sewing-enabled area 120 that is designated as the designated position. Therefore, the sewing machine 1 is able to specify the designated position accurately.

In a case where the embroidery frame 36 is used, in which the size of the sewing-enabled area 120 is smaller than that of the specification-enabled area 101, as described above, it is not necessary to establish sub-areas. In other words, it is acceptable for the establishing of the sub-areas to be determined in accordance with the size of the embroidery frame. Furthermore, as will be described in detail later, the sewing machine 1 may be provided with a determination portion that determines the size (the type) of the embroidery frame that is mounted on the embroidery device 2. The sewing machine 1 may also be configured to perform processing that determines whether the embroidery frame requires the establishing of the sub-areas and then control the embroidery device 2 based on that determination.

Figure 15:
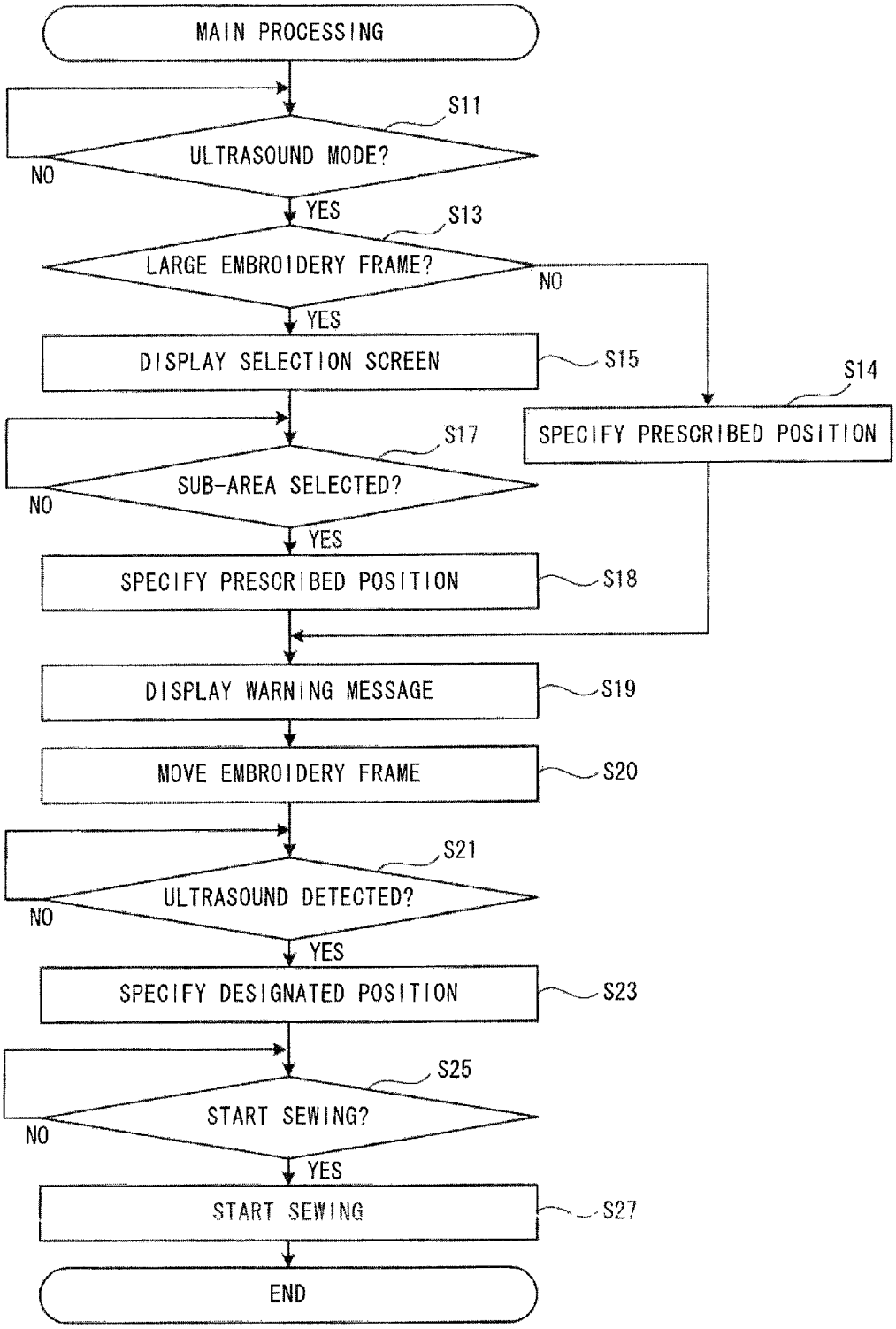
FIG. 15 is a flowchart that shows main processing.

Main processing will be explained with reference to FIG. 15. The CPU 61 performs the main processing in accordance with a program that is stored in the ROM 62. The CPU 61 starts the main processing when, for example, a panel operation for performing sewing on the work cloth 100 is detected.

The CPU 61 determines whether a panel operation has been detected that shifts the sewing machine 1 into an ultrasound mode (Step S11). The ultrasound mode is an operating mode in which the sewing machine 1 is able to detect the ultrasonic waves that are transmitted from the ultrasound pen 91. In a case where the panel operation that shifts to the ultrasound mode has not been detected (NO at Step S11), the CPU 61 returns the processing to Step S11.

In a case where the panel operation that shifts to the ultrasound mode has been detected (YES at Step S11), the CPU 61 determines the type of the embroidery frame that is mounted in the frame holder 55 of the embroidery device 2. Specifically, a plurality of projecting portions (not shown in the drawings), for example, may be formed such that the plurality of projecting portions are lined up on an attachment portion (not shown in the drawings) by which the embroidery frame is attached to the frame holder 55. On the frame holder 55 side, a plurality of switches (not shown in the drawings) are provided such that the plurality of switches are lined up in positions that correspond to the individual ones of the plurality of the projecting portions. In a state in which the embroidery frame is attached to the frame holder 55, the plurality of the projecting portions that are formed on the attachment portion can come into contact with the corresponding ones of the plurality of the switches that are provided on the frame holder 55. The number and the arrangement of the plurality of the projecting portions are different for each type of embroidery frame. Therefore, in a case where the embroidery frame is mounted in the frame holder 55, the number and the arrangement of the switches, among the plurality of the switches, with which the projecting portions come into contact are different for each type of embroidery frame. When the embroidery frame is mounted in the frame holder 55, the CPU 61 determines the type of the embroidery frame by detecting contact states of the individual ones of the plurality of the switches. The contact state is a state in which the projecting portion is in contact with the switch. Note that the method that is described above is only an example, and the CPU 61 may also determine the type of the embroidery frame by other methods that use various types of sensors.

The CPU 61 determines whether the embroidery frame that is mounted in the frame holder 55 of the embroidery device 2 is a large embroidery frame (Step S13). In a case where, based on the type of the embroidery frame that CPU 61 has determined, for example, the entire sewing-enabled area of the mounted embroidery frame is accommodated within the specification-enabled area 101, the CPU 61 determines that the mounted embroidery frame is a small embroidery frame. In contrast, in a case where the entire sewing-enabled area of the mounted embroidery frame is not accommodated within the specification-enabled area 101, the CPU 61 determines that the mounted embroidery frame is the large embroidery frame. In a case where the embroidery frame that is mounted in the frame holder 55 of the embroidery device 2 is the large embroidery frame 35 (YES at Step S13), the CPU 61 displays a selection screen on the LCD 15 (Step S15). The selection screen is a screen on which the operator is able to select one of the sub-areas 111 to 114 (refer to FIG. 8 and the like). The CPU 61 determines whether a panel operation has been detected that selects one of the sub-areas 111 to 114 (Step S17). In a ease where the panel operation has not been detected (NO at Step S17), the CPU 61 returns the processing to Step S17. In a case where the panel operation that selects one of the sub-areas 111 to 114 has been detected (YES at Step S17), the CPU 61 specifies a post-move position for the embroidery frame 35 (Step S18). In the present embodiment, the position of the embroidery frame 35 that has been moved is also referred to as a prescribed position. A method for specifying the prescribed position in a case where the panel operation that selects one of the sub-areas 111 to 114 has been detected will be explained.

FIG. 16 shows a table 641 that is stored in the EEPROM 64. Identification information items are stored in the table 641 in association with coordinate information items (X coordinates and Y coordinates) for each of the identification information items. The identification information item is information item that identifies one of the sub-areas 111 to 114. The coordinate information item is information item that indicates the position of the embroidery frame 35 in a case where one of the sub-areas 111 to 114 is selected. For example, the coordinate information item may be coordinate information that indicates the position of the center point of the embroidery frame when the embroidery frame is positioned at the prescribed position. The center point of the embroidery frame is the point of intersection of the line segments 117, 118. In the present embodiment, in the sewing machine 1, the direction from left to right and the direction from the front to the rear are the positive directions on the X axis and the Y axis, respectively. The CPU 61 selects the coordinate information item that is associated with the identification information item that identifies the sub-area that was selected by the panel operation that was detected at Step S17 (refer to FIG. 15). The CPU 61 specifies, as the prescribed position, the position that is specified by the selected coordinate information item.

Figure 9:
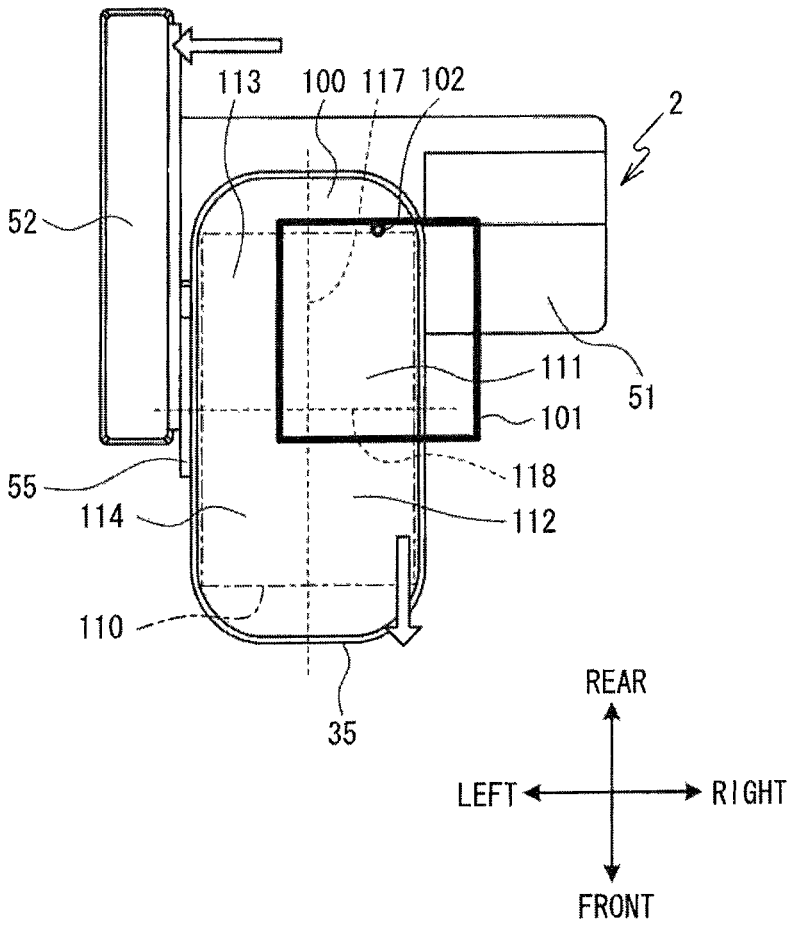
FIG. 9 is an explanatory figure of the embroidery device on which the embroidery frame is mounted and the specification-enabled area.

For example, the prescribed position that is specified by the coordinate information (Px, Py) that corresponds to the sub-area 111 is equivalent to the position of the embroidery frame 35 that is shown in FIG. 9. In the same manner, the prescribed position that is specified by the coordinate information (Qx, Qy) that corresponds to the sub-area 112 is equivalent to the position of the embroidery frame 35 that is shown in FIG. 10. The prescribed position that is specified by the coordinate information (Rx, Ry) that corresponds to the sub-area 113 is equivalent to the position of the embroidery frame 35 that is shown in FIG. 11. The prescribed position that is specified by the coordinate information (Sx, Sy) that corresponds to the sub-area 114 is equivalent to the position of the embroidery frame 35 that is shown in FIG. 12. The coordinate information for specifying the prescribed position can thus be stored by the sewing machine 1 in advance in the EEPROM 64 for each of the sub-areas 111 to 114. Therefore, the CPU 61 is able to specify the post-move position of the embroidery frame 35 and move the embroidery frame 35 to the prescribed position.

After the prescribed position has been specified, the CPU 61 displays a warning message on the LCD 15 (Step S19). The warning message may be, for example, a message says, "The embroidery frame will move." The warning message may be displayed for five seconds, for example. By displaying the message, the sewing machine 1 can prompt the operator to pay attention to the fact that the embroidery frame 35 will move. The CPU 61 then operates the X axis motor 86 and the Y axis motor 87 such that the embroidery frame 35 is moved to the specified prescribed position. In this manner, the CPU 61 causes embroidery device 2 to move the embroidery frame 35 to the prescribed position (Step S20). The CPU 61 advances the processing to Step S21.

At Step S13, in a case where the embroidery frame that is mounted in the frame holder 55 of the embroidery device 2 is the small embroidery frame 36 (NO at Step S13), the CPU 61 specifies, as the prescribed position, the position of the embroidery frame 36 where the entire sewing-enabled area 120 (refer to FIG. 13) is accommodated within the specification-enabled area 101 (Step S14). Note that, in a case where the embroidery frame that is mounted in the frame holder 55 of the embroidery device 2 is the small embroidery frame 36, the coordinate information that indicates the prescribed position is stored in the EEPROM 64 in advance. The CPU 61 specifies the prescribed position by reading the coordinate information from the EEPROM 64. The CPU 61 displays the warning message on the LCD 15 (Step S19). The CPU 61 operates the X axis motor 86 and the Y axis motor 87 such that the embroidery frame 36 is moved to the specified prescribed position. In this manner, the CPU 61 causes embroidery device 2 to move the embroidery frame 36 to the prescribed position (Step S20). The CPU 61 advances the processing to Step S21.

The CPU 61 determines whether the ultrasonic waves have been detected through the receivers 94, 95 (Step S21). In a case where the ultrasonic waves have not been detected through the receivers 94, 95 (NO at Step S21), the CPU 61 returns the processing to Step S21.

In a case where the operator has pressed the pen tip 911 of the ultrasound pen 91 against the work cloth 100, the signal output circuit 914 of the ultrasound pen 91 outputs an electrical signal through the cable 912. At the same time, the ultrasound transmitter 915 of the ultrasound pen 91 transmits the ultrasonic waves. The CPU 61 detects the electrical signal that has been output from the ultrasound pen 91 through the cable 912. The CPU 61 specifies the time that the electrical signal was detected as the transmission time T1. After specifying the transmission time T1, the CPU 61 detects the ultrasonic waves through the receivers 94, 95. The CPU 61 specifies the time that the ultrasonic waves were detected as the detection times T2.

In a case where the ultrasonic waves have been detected through the receivers 94, 95 (YES at Step S21), the CPU 61 specifies the designated position by computing the designated coordinates E based on the transmission time T1 and the pair of the detection times T2 (Step S23). The CPU 61 determines whether, among the operation switches 21, the operation of the start-and-stop switch for starting the sewing has been detected (Step S25). In a case where the operation of the start-and-stop switch has not been detected (NO at Step S25), the CPU 61 returns the processing to Step S25. In a case where the operation of the start-and-stop switch has been detected (YES at Step S25), the CPU 61 performs control for starting the sewing from the designated position. The control for starting the sewing from the designated position may be as hereinafter described, for example. By operating the X axis motor 86 and the Y axis motor 87, the CPU 61 operates the X axis moving mechanism and the Y axis moving mechanism such that the position that is indicated by the X coordinate (Xe) and the Y coordinate (Ye) of the computed designated coordinates E becomes coincident with the needle drop point 102 (refer to FIG. 8 and the like). The embroidery frame that is held by the carriage 52 is moved. The work cloth 100 that is held in the embroidery frame is moved such that the designated position is disposed directly below the sewing needle (directly above the needle drop point 102). The CPU 61 causes the needle bar 29 to move up and down by operating the sewing machine motor 79. The CPU 61 moves the embroidery frame by controlling the embroidery device 2. In this manner, the CPU 61 causes the sewing machine 1 to start the sewing of the embroidery pattern in the designated position on the work cloth 100 that is held in the embroidery frame (Step S27). The CPU 61 terminates the main processing.

As explained above, by moving the embroidery frame to the prescribed position, the sewing machine 1 is able to specify the position on the work cloth 100 that was designated using the ultrasound pen 91. That is, the sewing machine can specify the designated position.

Note that the present disclosure is not limited to the embodiment that is described above, and various types of modifications can be made. In the explanation above, the sewing machine 1 is used in a state in which the embroidery device 2, which can be mounted and removed, has been mounted. However, the sewing machine 1 may also be an embroidery sewing machine that is provided with an integral embroidery device 2 function. The sewing machine 1 may also be an embroidery sewing machine that is provided with a plurality of needle bars.

In the embodiment that is described above, the sewing machine 1 specifies the designated position based on the transmission time T1 and the pair of the detection times T2 for the ultrasonic waves. The method for specifying the designated position may also be a different method. For example, the sewing machine 1 may specify the designated position based only on the transmission time T1 for the ultrasonic waves. Note that the sewing machine 1 may also be provided with more than two of the receivers, although a detailed explanation of this will be omitted. The sewing machine 1 can then specify the designated position by specifying the pair of the detection times T2 when the ultrasonic waves are detected for each of the receivers.

In the explanation above, in a case where the embroidery frame 35 is mounted on the embroidery device 2, the sewing machine 1 determines the prescribed position that corresponds to the one of the sub-areas 111 to 114 that the operator has established by the panel operation, and then the sewing machine 1 moves the embroidery frame 35 accordingly. However, it is also acceptable for the sewing machine 1 not to establish the sub-areas in advance, for example. The operator may also use a panel operation to select the position within the sewing-enabled area 110 that the operator wants to designate by using the ultrasound pen 91. The sewing machine 1 may also move the embroidery frame 35 such that the selected position and an area that includes the area around the selected position are accommodated within the specification-enabled area 101. For example, the sewing machine 1 may move the embroidery frame 35 such that the selected position is positioned in the center of the specification-enabled area 101. For example, the sewing machine 1 specifies coordinate information that indicates a position of the center of the specification-enabled area 101 based on the coordinate information that indicates the positions of the four vertices of the specification-enabled area 101. The sewing machine 1 may specify the prescribed position based on coordinate information that indicates the selected position and the specified coordinate information that indicates the position of the center of the specification-enabled area 101. That is, the sewing machine 1 may specify the prescribed position based on a positional relationship between the specification-enabled area 101 and the area that includes the area around the selected position.

The positioning of the specification-enabled area 101 in relation to the needle drop point 102 is not limited to the example that is described above. For example, the specification-enabled area 101 may also be defined such that the needle drop point 102 is positioned in the center of the specification-enabled area 101. The shape of the specification-enabled area 101 is not limited to being a square. The shape of the specification-enabled area 101 may also be one of a circle, an ellipse, and a polygon. In the explanation above, the sewing-enabled area 110 is divided into the four sub-areas 111 to 114. However, the number of the sub-areas is not limited to four. The number of the sub-areas may also be one of two, three, and more than four. The shapes of the sub-areas are also not limited to being rectangles. The shapes of the sub-areas may be defined as any shapes that in accordance with the shape of the embroidery frame 35.

The apparatus and methods described above with reference to the various embodiments are merely examples. It goes without saying that they are not confined to the depicted embodiments. While various features have been described in conjunction with the examples outlined above, various alternatives, modifications, variations, and/or improvements of those features and/or examples may be possible. Accordingly, the examples, as set forth above, are intended to be illustrative. Various changes may be made without departing from the broad spirit and scope of the underlying principles.

What is claimed is:

1. A sewing machine, comprising:

a detector configured to detect ultrasonic waves transmitted from a specification-enabled area;

a processor; and a memory storing non-transitory computer-readable instructions that instruct the sewing machine to perform specifying a prescribed position based on a positional relationship between a transmission area and the specification-enabled area, the transmission area being an area that is at least a portion of a sewing-enabled area and being an area that includes a position of a transmission source that transmits the ultrasonic waves, the prescribed position being a position of an embroidery frame when the entire transmission area is included in the specification-enabled area, the embroidery frame being configured to be mountable in the sewing machine and configured to hold a work cloth, and the sewing-enabled area being an area in which the sewing machine is able to perform sewing on the work cloth that is held by the embroidery frame;

moving the embroidery frame to the specified prescribed position;

specifying a transmission position based on the ultrasonic waves that are detected by the detector, the transmission position being a position of the transmission source that transmits the ultrasonic waves; and performing a sewing operation based on the specified transmission position, the sewing operation being an operation by which the sewing machine performs the sewing on the work cloth that is held by the embroidery frame.

2. The sewing machine according to claim 1, further comprising:

a needle bar that extends in a first direction and to a one end of which a sewing needle is attachable; and an operation portion that is provided on a second direction side of the sewing machine, the second direction being a direction that is orthogonal to the first direction, wherein the specification-enabled area includes a first area and a second area, the first area being an area that is larger than the second area and being on the second direction side of a boundary line, the second area being an area that is on a third direction side of the boundary line, the third direction being the opposite direction from the second direction, the boundary line being a line that passes through a needle drop point and extends in both directions that are orthogonal to each of the first direction and the second direction, and the needle drop point being a position at which the sewing needle that is attached to the needle bar pierces the work cloth that is held by the embroidery frame.

3. The sewing machine according to claim 1, wherein the computer-readable instructions further comprise instructions to perform:

receiving transmission area information, the transmission area information being information that specifies a position of the transmission area, and wherein the specifying the prescribed position comprises specifying the prescribed position based on the received transmission area information.

4. The sewing machine according to claim 3, further comprising:

a needle bar that extends in a first direction;

an operation portion that is provided on a second direction side of the sewing machine, the second direction being a direction that is orthogonal to the first direction, wherein the memory further stores an identification information item and a prescribed position information item for each of a plurality of sub-areas in association with one another, the plurality of the sub-areas being a plurality of areas into which the sewing-enabled area is divided, the identification information item being an information item that identifies the corresponding one of the plurality of the sub-areas, and the prescribed position information item being an information item that indicates the prescribed position in a case where the one sub-area that is associated with the prescribed position information item is selected from among the plurality of the sub-areas, wherein the computer-readable instructions further comprise instructions to perform:

receiving an instruction to select one of the sub-areas from among the plurality of the sub-areas from the operation portion, and wherein the specifying the prescribed position comprises specifying the prescribed position based on the prescribed position information item that is associated with the identification information item that identifies the one selected sub-area.

5. The sewing machine according to claim 4, further comprising a display, and wherein the computer-readable instructions further comprise instructions to perform:

transmitting instructions that cause the display to display positions of the plurality of sub-areas to the display based on the prescribed position information item that is associated with the identification information item for each of the plurality of sub-areas.

6. The sewing machine according to claim 1, wherein the computer-readable instructions further comprise instructions to perform:

specifying a type of the embroidery frame that is mounted in the sewing machine, and wherein the specifying the prescribed position comprises specifying the prescribed position based on the specified type of the embroidery frame.

7. The sewing machine according to claim 6, wherein the memory further stores first prescribed position information, the first prescribed position information being information that indicates the prescribed position in a case where the embroidery frame that is mounted in the sewing machine is a first embroidery frame, the first embroidery frame being an embroidery frame that has a first sewing-enabled area, and the first sewing-enabled area being a sewing-enabled area that is smaller than the specification-enabled area, wherein the computer-readable instructions further comprise instructions to perform:

determining whether an embroidery frame that is mounted in the sewing machine is the first embroidery frame, and wherein the specifying the prescribed position comprises specifying the prescribed position based on the first prescribed position information in a case where it has been determined that the embroidery frame that is mounted in the sewing machine is the first embroidery frame.

8. The sewing machine according to claim 6, wherein the computer-readable instructions further comprise instructions to perform:

determining whether an embroidery frame that is mounted in the sewing machine is a second embroidery frame, the second embroidery frame being an embroidery frame that has a second sewing-enabled area, and the second sewing-enabled area being a sewing-enabled area that is larger than the specification-enabled area, and receiving transmission area information in a case where it has been determined that the embroidery frame that is mounted in the sewing machine is the second embroidery frame, the transmission area information being information that specifies the position of the transmission area, and wherein the specifying the prescribed position comprises specifying the prescribed position based on the received transmission area information.

9. The sewing machine according to claim 8, wherein the memory further stores an identification information item and a prescribed position information item for each of a plurality of sub-areas in association with one another, the plurality of the sub-areas being a plurality of areas into which the second sewing-enabled area is divided, the identification information item being an information item that identifies the corresponding one of the plurality of the sub-areas, and the prescribed position information item being an information item that indicates the prescribed position in a case where the one sub-area that is associated with the prescribed position information item is selected from among the plurality of the sub-areas, wherein the computer-readable instructions further comprise instructions to perform:

receiving an instruction to select one of the sub-areas from among the plurality of the sub-areas, in a case where it has been determined that the embroidery frame that is mounted in the sewing machine is the second embroidery frame, and wherein the specifying the prescribed position comprises specifying the prescribed position based on the prescribed position information item that is associated with the identification information item that identifies the one selected sub-area.

10. The sewing machine according to claim 1, further comprising a connector configured to be electrically connectable to the transmission source.

11. The sewing machine according to claim 10, wherein the computer-readable instructions further comprise instructions to perform:

receiving a electrical signal that is output from the transmission source through the connector, wherein the specifying the transmission position comprises specifying the transmission position based on a first timing and a second timing, the first timing being a timing that the electrical signal is received, and the second timing being a timing that the ultrasonic waves are detected.

* * * * *